US011574619B2

(12) United States Patent
Su et al.

(10) Patent No.: US 11,574,619 B2
(45) Date of Patent: Feb. 7, 2023

(54) ACOUSTIC STRUCTURE FOR BEAMING SOUNDWAVES

(71) Applicant: Toyota Motor Engineering & Manufacturing North America, Inc., Plano, TX (US)

(72) Inventors: Xiaoshi Su, Ann Arbor, MI (US); Debasish Banerjee, Ann Arbor, MI (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 311 days.

(21) Appl. No.: 17/036,538

(22) Filed: Sep. 29, 2020

(65) Prior Publication Data

US 2022/0101824 A1 Mar. 31, 2022

(51) Int. Cl.

| | |
|---|---|
| ***G10K 11/32*** | (2006.01) |
| ***G10K 11/26*** | (2006.01) |
| ***H01P 3/12*** | (2006.01) |
| ***H01P 3/16*** | (2006.01) |
| *G10K 11/18* | (2006.01) |

(52) U.S. Cl.

CPC ..... *G10K 11/32* (2013.01)

(58) Field of Classification Search

CPC ..... G10K 11/32; G10K 11/18; G10K 11/26; H01P 3/12; H01P 3/122; H01P 3/16; H01P 3/165; H01P 3/20

See application file for complete search history.

(56) References Cited

U.S. PATENT DOCUMENTS 2,684,724 A * 7/1954 Kock ..... H01Q 15/02 84/400
5,220,535 A * 6/1993 Brigham ..... G10K 11/172 367/1
7,315,663 B2 * 1/2008 Wu ..... B82Y 20/00 385/9

(Continued)

FOREIGN PATENT DOCUMENTS

CN 104464715 B * 12/2017
CN 107424599 A * 12/2017 ..... G10K 11/26

(Continued)

OTHER PUBLICATIONS

Bai et al., "Extraordinary lateral beaming of sound from a square-lattice phononic crystal," Physics Letters A, 381, pp. 886-889 (2017).

(Continued)

*Primary Examiner* — Edgardo San Martin
(74) *Attorney, Agent, or Firm* — Christopher G. Darrow; Darrow Mustafa PC

(57) ABSTRACT

An acoustic structure for beaming soundwaves from a first direction toward a second direction, may include a plurality of phononic crystals. The plurality of phononic crystals have an outer border, an internal cavity and a channel extending between the outer border and the internal cavity, wherein the channel defines an opening within the outer border. The phononic crystals are disposed such that the opening faces the second direction. Soundwaves from the first direction are beamed to the second direction by the plurality of phononic crystals.

20 Claims, 4 Drawing Sheets

(56) References Cited

U.S. PATENT DOCUMENTS

| | | | | |
|---|---|---|---|---|
| 3,054,145 | A1 | 11/2011 | Mohammadi et al. | |
| 8,570,643 | B2 * | 10/2013 | Yamada | B82Y 20/00 359/577 |
| 8,596,410 | B2 * | 12/2013 | Deymier | G10K 11/165 181/176 |
| 8,662,249 | B2 * | 3/2014 | Nair | G10K 11/168 181/290 |
| 8,789,652 | B2 * | 7/2014 | Swallowe | G10K 11/172 181/295 |
| 9,130,250 | B2 * | 9/2015 | Kitaoka | C23C 14/225 |
| 9,465,141 | B2 * | 10/2016 | Steinhardt | G01K 17/00 |
| 9,607,600 | B2 * | 3/2017 | Swallowe | G10K 11/172 |
| 9,765,516 | B2 * | 9/2017 | Van Dinther | E04B 1/8209 |
| 10,460,714 | B1 * | 10/2019 | Koch | G10K 11/162 |
| 10,783,871 | B2 * | 9/2020 | Norris | G10K 11/30 |
| 11,100,914 | B1 * | 8/2021 | Perahia | G10K 11/18 |
| 11,244,667 | B1 * | 2/2022 | Perahia | G10K 11/04 |
| 11,415,556 | B2 * | 8/2022 | Lee | G01N 29/2487 |
| 2013/0162375 | A1 * | 6/2013 | Kitaoka | G02B 1/002 977/734 |
| 2021/0373201 | A1 * | 12/2021 | Steinhardt | G02B 5/3025 |

FOREIGN PATENT DOCUMENTS

| | | | | |
|---|---|---|---|---|
| CN | 107424599 B | * | 3/2021 | G10K 11/26 |
| CN | 113300688 A | * | 8/2021 | |

OTHER PUBLICATIONS

Elford et al., "Matryoshka Locally Resonant Sonic Crystal," 7 pages, arXiv:1102.0399v1 [cond-mat.mtrl-sci] Feb. 2, 2011.

Miniaci et al., "Proof of Concept for an Ultrasensitive Technique to Detect and Localize Sources of Elastic Nonlinearity Using Phononic Crystals," Physical Review Letters 118, No. 21, 6 pages (2017).

Hajian et al., "Enhanced transmission and beaming via a zero-index photonic crystal," Appl. Phys. Lett. 109, 031105, 6 pages (2016).

Hussein et al., "Dynamics of Phononic Materials and Structures: Historical Origins, Recent Progress, and Future Outlook," Applied Mechanics Reviews 66, No. 4, 52 pages, (2014).

* cited by examiner

ACOUSTIC STRUCTURE FOR BEAMING SOUNDWAVES

TECHNICAL FIELD

The present disclosure relates to acoustic structures that beam soundwaves and, more specifically, to acoustic structures having phononic crystals that beam soundwaves.

BACKGROUND

The background description provided is to present the context of the disclosure generally. Work of the inventors, to the extent it may be described in this background section, and aspects of the description that may not otherwise qualify as prior art at the time of filing, are neither expressly nor impliedly admitted as prior art against the present technology.

Some traditional methodologies for directing soundwaves involve the use of waveguides. A waveguide is a structure that guides soundwaves by restricting the transmission of energy in one direction. Without the physical constraint of a waveguide, wave amplitudes decrease according to the inverse square law as they expand into a three-dimensional space.

The geometry of a waveguide may dictate its function. For example, in addition to more common types that channel the wave in one dimension, there are two-dimensional slab waveguides that confine waves to two dimensions. The frequency of the transmitted wave also dictates the size of a waveguide, as each waveguide has a cutoff wavelength determined by its size and will not conduct waves of greater wavelength.

SUMMARY

This section generally summarizes the disclosure and is not a comprehensive disclosure of its full scope or all its features.

Examples of acoustic structures for beaming soundwaves are described herein. An acoustic structure for beaming soundwaves from a first direction toward a second direction may include a plurality of phononic crystals. The plurality of phononic crystals may have an outer border, an internal cavity, and a channel extending between the outer border and the internal cavity. The channel may define an opening within the outer border. The phononic crystals are placed such that the opening faces the second direction. Soundwaves from the first direction are beamed to the second direction by the plurality of phononic crystals. The second direction may be approximately 90 degrees with respect to the first direction. As such, the openings of the phononic crystals that form the acoustic structure may be 90° with respect to the soundwaves coming from the first direction.

The phononic crystals may each have a resonant frequency that is lower than the frequency of the soundwaves beamed from the first direction to the second direction (working frequency) by the acoustic structure. Further still, the phononic crystals may be arranged in a lattice, wherein the distance between each of the phononic crystals is dictated by the working frequency of the acoustic structure. Moreover, in one example, the distance between the phononic crystals that form the lattice may be substantially equal to the speed of sound divided by the working frequency of the acoustic structure.

The phononic crystals may take any one of several different shapes. In one example, the phononic crystals may be cylindrical in shape. However, in other examples, the phononic crystals may be prisms, such as cuboids. The same is also true for the internal cavity, wherein the internal cavity can take several different shapes and is not necessarily dictated by the overall shape of the phononic crystal. For example, a phononic crystal in the shape of a cuboid may have a cylindrical internal cavity.

Further areas of applicability and various methods of enhancing the disclosed technology will become apparent from the description provided. The description and specific examples in this summary are intended for illustration only and are not intended to limit the scope of the present disclosure.

BRIEF DESCRIPTION OF THE DRAWINGS

The present teachings will become more fully understood from the detailed description and the accompanying drawings, wherein.

The figures set forth herein are intended to exemplify the general characteristics of the methods, algorithms, and devices among those of the present technology, for the purpose of the description of certain aspects. These figures may not precisely reflect the characteristics of any given aspect and are not necessarily intended to define or limit specific embodiments within the scope of this technology. Further, certain aspects may incorporate features from a combination of figures.

DETAILED DESCRIPTION

Described is an acoustic structure that can beam sound from one direction to another. In one example, the acoustic structure may laterally beam sound. Instead of using waveguides, the acoustic structure uses a plurality of phononic crystals. The phononic crystals may have an internal cavity. A channel is formed within the phononic crystals that extends from the internal cavity to an outer border of the phononic crystals and defines an opening. In one example, the phononic crystals may be arranged in a lattice, wherein the opening of the phononic crystals substantially face a direction that is lateral with respect to the direction of incident soundwaves. The acoustic structure receives the incident soundwaves and at least a portion of the incident soundwaves are laterally beamed.

Figure 1A:
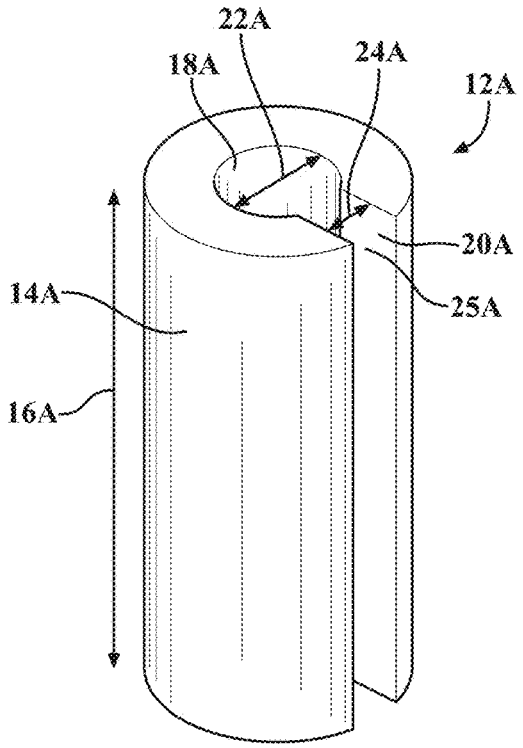
FIGS. 1A and 1B illustrate a perspective view and a top view of a cylindrical phononic crystal for use with an acoustic structure, respectively.
Figure 1B:
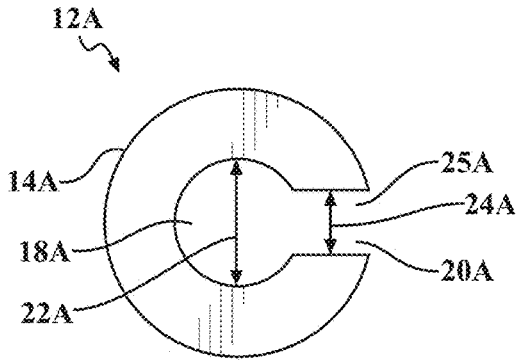

Referring to FIGS. 1A and 1B, a phononic crystal 12A that may be utilized in an acoustic structure is shown. Here, the phononic crystal 12A is in the shape of a cylinder having a length 16A. The phononic crystal 12A may be made of artificial periodic composite materials having periodically distributed individuals in a matrix with high impedance contrast of mass densities and/or elastic moduli, which can give rise to new acoustic dispersions and band structures due to the periodic Bragg scattering as well as localized Mie scatterings from the individuals. As such, any material that meets these criteria can be utilized, such as glass, plastic, or any other acoustically hard material.

As stated before, the phononic crystal 12A is in the shape of a cylinder that extends along a length 16A. Generally, the phononic crystal 12A has an outer border 14A. In this example, the outer border 14A is generally circular. Located within the phononic crystal 12A is an internal cavity 18A. Here, the internal cavity 18A is shown to be circular—similar to the outer border 14A of the phononic crystal. However, it should be understood that the internal cavity 18A may take any one of several different shapes and is not limited to a circular shape. Generally, the internal cavity 18A extends along the length 16A.

The phononic crystal 12A also includes a channel 25A that extends from the internal cavity 18A towards the outer border 14A, thus defining an opening 20A formed within the phononic crystal 12A. The opening 20A may extend along the length 16A, similar to the internal cavity 18A and/or the outer border 14A and may be in the shape of a slot. The width 24A of the channel 25A may be substantially equal to or less than the width 22A of the cross-section of the internal cavity 18A. In this example, the width 24A of the channel 25A is shown to be less than the width 22A of the internal cavity 18A. The terms "substantially equal" and/or "substantially similar" and/or "approximately" should be understood to be within 10% of the dimension to which it is compared. This definition of these terms can be used throughout this description.

The phononic crystal 12A may have a resonant frequency that is lower than the frequencies of the soundwaves that will be laterally beamed by an acoustic structure that utilizes several phononic crystals, such as the phononic crystal 12A. The frequencies of the soundwaves that will be laterally beamed by an acoustic structure that utilizes several phononic crystals, similar to the phononic crystal 12A, may be referred to as a "working frequency." Because the monopole response of the phononic crystal 12A is much larger than the dipole response at the resonant frequency, the resonant frequency of the phononic crystal 12A may not be the same as the working frequency. However, the monopole response will decrease when the frequency is far from the resonance and the dipole response will increase with the frequency. The monopole and dipole responses of the phononic crystal 12A may be tuned by shifting the resonance to a lower frequency. In one example, the resonant frequency of the phononic crystals 12A may be lower than the working frequency by 10% or more.

Generally, by changing the volume of the internal cavity 18A and/or the width 24A of channel 25A, the resonant frequency of the phononic crystal 12A can be changed. The phononic crystal 12A has a resonance lower than the frequency of the soundwave to be beamed (working frequency), so scattering is strong near that frequency. This strong scattering has both monopole and dipole components, and their interference makes the wave propagation to the left and right different. The resonant frequency of the phononic crystal 12A can be related to the internal geometry of the phononic crystal 12A by:

$$f = \frac{c}{2\pi}\sqrt{\frac{w}{SL}},$$

where c is the sound speed, w is the width 24A, S is the area of the internal cavity 18A, L is the length 16A of the channel 25A.

Figure 2A:
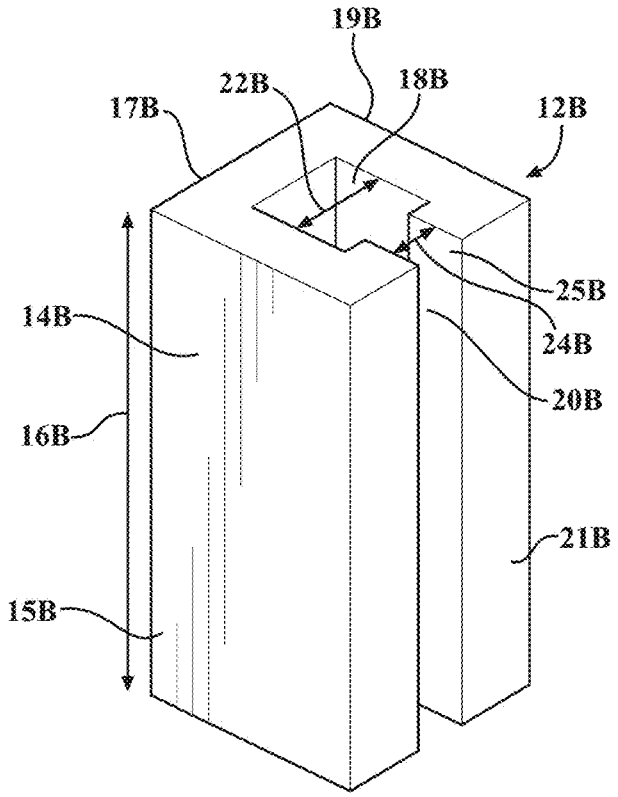
FIGS. 2A and 2B illustrate a perspective view and a top view of a cuboid phononic crystal for use with an acoustic structure, respectively.
Figure 2B:
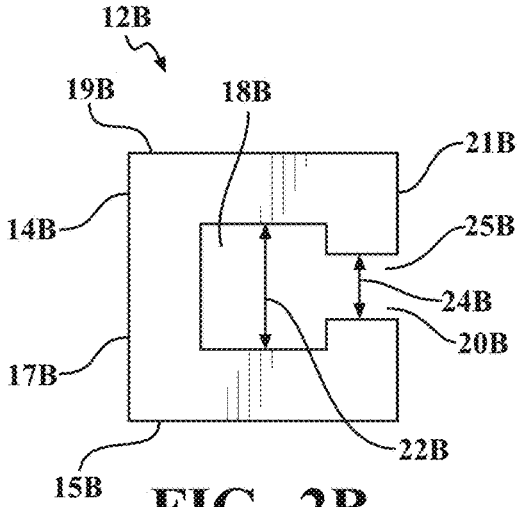

The phononic crystal 12A shown in the FIGS. 1A and 1B is cylindrical. However, it should be understood that the phononic crystal 12A can take any one of many different forms, such as a prism-shaped phononic crystal. Moreover, referring to FIGS. 2A and 2B, illustrated is a phononic crystal 12B that is in the shape of a cuboid. As stated before, this is just but one example. The phononic crystal 12B could be other prism type shapes having any one of a number of sides.

Like before, the phononic crystal 12B generally extends along the length 16B and has an outer border 14B. Unlike the circular outer border 14A of the phononic crystal 12A of FIGS. 1A and 1B, the outer border 14B of the phononic crystal 12B is rectangular and includes four different sides 15B, 17B, 19B, and 21B.

Located within the phononic crystal 12B is an internal cavity 18B. In this example, the internal cavity 18B is rectangular and generally extends along the length 16B. However, it should be understood that the shape of the internal cavity 18B can take any one of several different shapes and is not dictated by the overall shape of the outer border 14B. As such, in this example, while the outer border 14B has four different sides 15B, 17B, 19B, and 21B, that generally form a cuboid, the cuboid shape defined by the outer border 14B does not dictate the overall shape of the internal cavity 18B. For example, the internal cavity 18B could be circular, similar to the internal cavity 18A shown in FIGS. 1A and 1B.

Located within the side 21B is an opening 20B. The opening is defined by a channel 25B that extends from the internal cavity 18B to the opening 20B. Generally, the opening 20B extends along the length 16B of the side 21B of the phononic crystal 12B. The width 24B of the channel 25B of the phononic crystal 12B may be substantially equal to or less than the width 22B of the internal cavity 18B. In this example, the width 24B is less than the channel 25B.

As explained previously, the phononic crystal 12B may have a resonant frequency that is lower than the frequencies of the soundwaves that will be laterally beamed by an acoustic structure that utilizes several phononic crystals, such as the phononic crystal 12B Like before, by changing the volume of the internal cavity 18B and/or the width 24B of channel 25B, the resonant frequency of the phononic crystal 12B can be changed.

Figure 3:
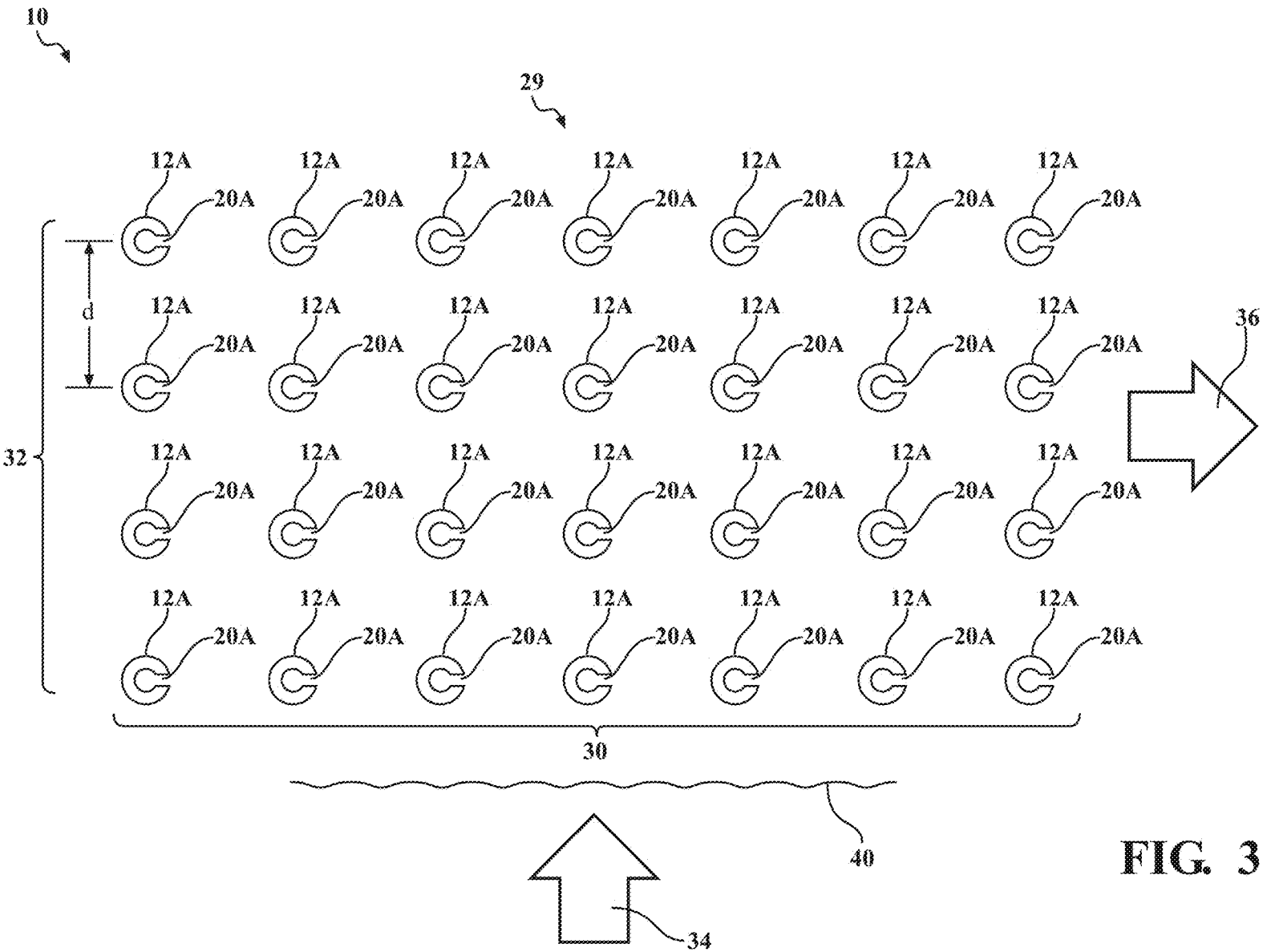
FIG. 3 illustrates one example of an acoustic structure having a plurality of cylindrical phononic crystals that form a square lattice.

Referring to FIG. 3, illustrated is one example of an acoustic structure 10 that incorporates a plurality of phononic crystals. In this example, the plurality of phononic crystals are similar to the phononic crystal 12A shown in FIGS. 1A and 1B. However, it should be understood that the acoustic structure 10 could use other types of phononic crystals, such as the phononic crystal 12B shown in FIGS. 2A and 2B and/or combinations thereof. As such, the acoustic structure 10 could utilize phononic crystals that are similar to each other in shape or could use phononic crystals that differ from each other in shape.

The phononic crystals 12A may be arranged in the form of a lattice 29. In this example, the lattice 29 may be a square lattice, wherein each of the phononic crystals 12A are separated from each other by a distance d. In one example, the distance d may be measured from the center of the internal cavities of the phononic crystals 12A. Alternatively, the distance d could be measured from the outer borders of the phononic crystals 12A.

The distance d is substantially similar to the wavelength of soundwaves that will be beamed by the acoustic structure 10. As such, the distance d may be dependent upon the working frequency of the acoustic structure. Moreover, each of the phononic crystals 12A have a resonant frequency that may be substantially equal to each other.

As such, the distance d between each of the phononic crystals 12A may be expressed as:

$$d=f/c,$$

wherein f is the working frequency of the acoustic structure 10, and c is the speed of sound. In one example, assume that the frequency of the soundwaves to be beamed by the acoustic structure 10 is 5200 Hz. As previously explained, the resonant frequencies of the phononic crystals 12A are lower than the working frequency so that the scattered monopole and dipole moments have substantially similar strength. The speed of sound may be 343 m/s (the speed of sound in air at 20° C.). As such, in this example, using the equation above, the distance d would be approximately 6.6 cm.

Therefore, to beam sounds at a different target frequency, the first step is to determine the distance between the phononic crystals 12A using the relation mentioned above and then design the internal structure of the phononic crystal 12A to make the resonant frequency lower than the target frequency so that the scattered monopole and dipole moments have substantially similar strength.

The phononic crystals 12A forming the lattice 29 may be orientated such that the openings 20A of the phononic crystals 12A substantially face a direction 36 to which soundwaves are beamed towards. The direction 36 may be lateral (or approximately 90°) from a direction 34. When configured as shown and described, a portion of the soundwaves traveling along the direction 34 towards the acoustic structure 10 are beamed toward the direction 36. In this example, a portion of the soundwaves that have a wavelength of approximately 5200 Hz will be beamed from the direction 34 to the direction 36.

In this example, the lattice 29 includes twenty-eight separate phononic crystals 12A organized in seven columns having four rows. It should be understood that the lattice 29 may include any one of a number of phononic crystals 12A and can be organized in any one of a number of different rows or columns. In this example, the lattice 29 includes a long side 30 (along the seven columns) and a short side 32 (along the four rows). Here, the long side 30 may substantially face the direction to which a sound is being projected towards the acoustic structure 10. The short side 32 may substantially face the direction 36 to which a portion of the soundwaves are beamed towards.

Figure 4:
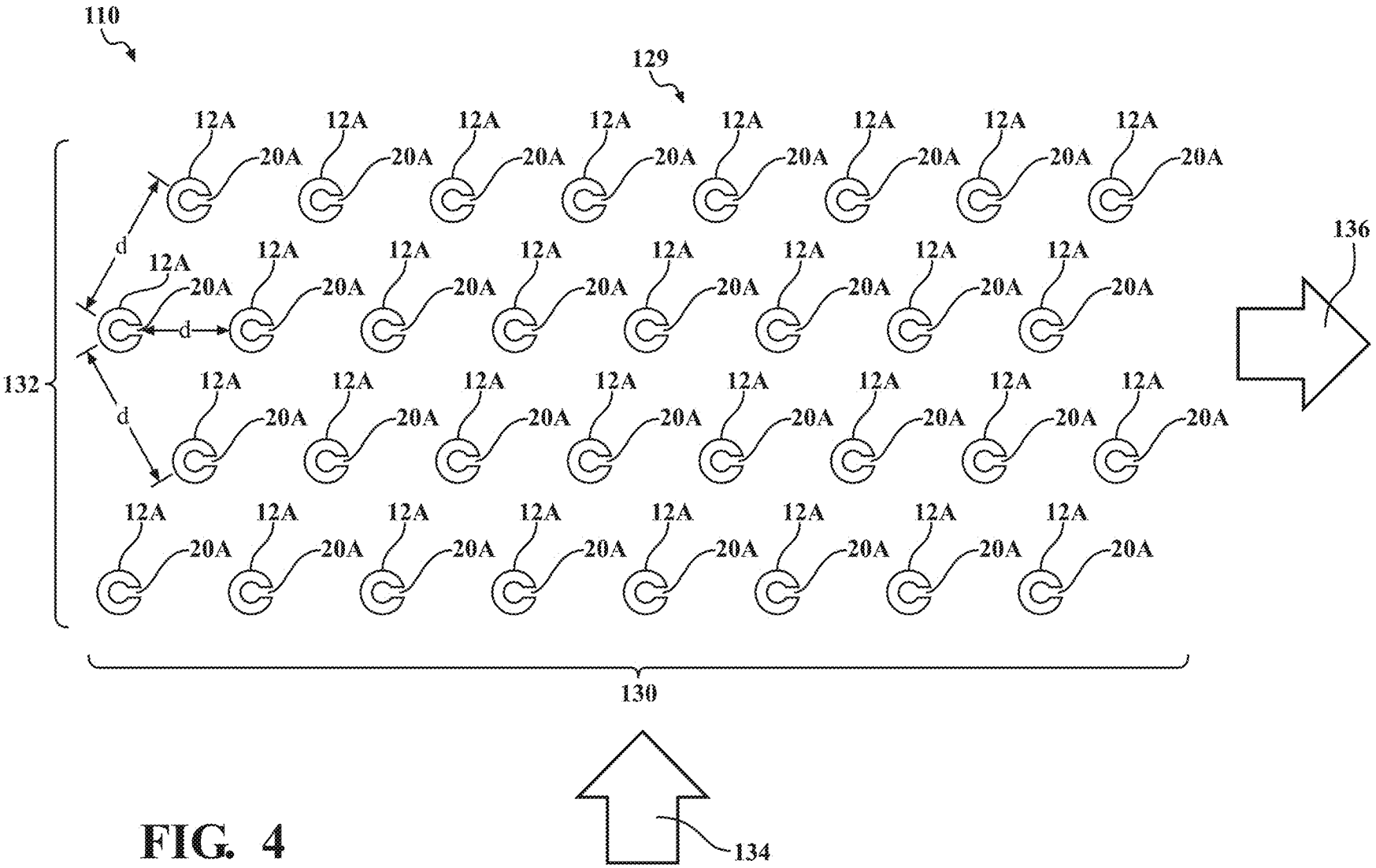
FIG. 4 illustrates one example of an acoustic structure having a plurality of cylindrical phononic crystals that form a triangular lattice.

The lattice 29 is in the form of a square lattice. However, the lattice 29 may take any one of many different configurations, such as a triangular and/or hexagonal lattice. For example, referring to FIG. 4, an acoustic structure 110 that includes a plurality of phononic crystals 12A is shown. The phononic crystals 12A are arranged in a lattice 129. The lattice 129 is a triangular lattice. Like before, the distance d is calculated by dividing the speed of sound by the working frequency of the acoustic structure 110. As such, the acoustic structure 110 exhibits similar properties as the acoustic structure 10, wherein a portion of soundwaves projected to the acoustic structure 110 in the direction 134 are laterally beamed by the acoustic structure 110 in the direction 136.

Figure 5:
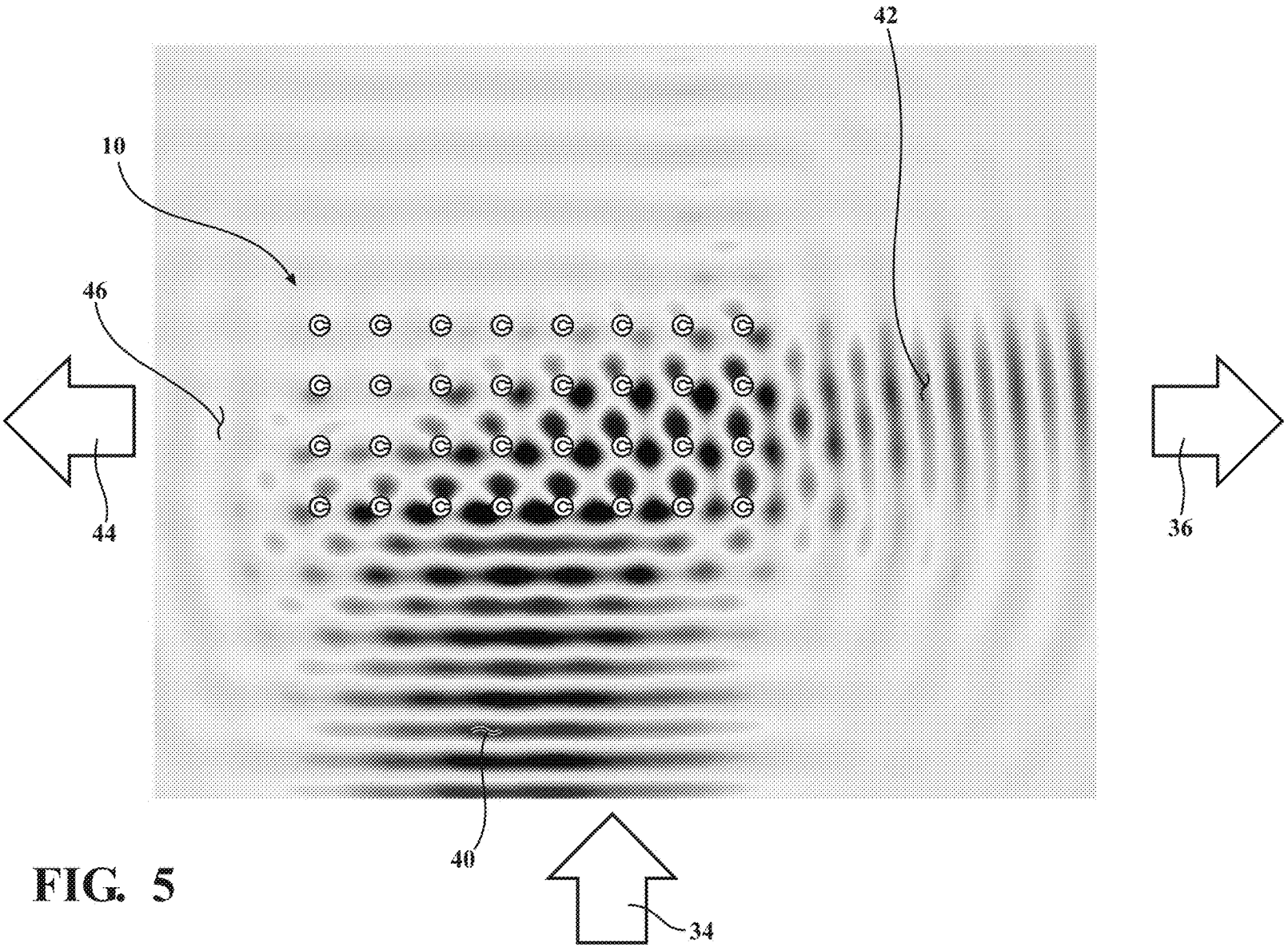
FIG. 5 illustrates the acoustic structure of FIG. 3 beaming soundwaves in a lateral direction.

Referring to FIG. 5, illustrated is the acoustic structure 10 of FIG. 3. Here, illustrated are soundwaves 40 directed towards the acoustic structure 10 along the direction 34. The soundwaves 40, in this example, may have a frequency of approximately 5200 Hz. The phononic crystals 12A making up the lattice that form the acoustic structure 10 may have resonant frequencies of approximately 4000 Hz so that the scattered monopole and dipole moments have substantially similar strength at 5200 Hz. The d distance between the phononic crystals 12A is measured from the center of the phononic crystals 12A and may be approximately 6.6 cm, is calculated using the equation mentioned above.

Here, this figure illustrates that a portion 42 of the soundwaves 40 from the direction 34 are laterally directed and direction 36. This is accomplished without utilizing a waveguide. In one example, the portion 42 of the soundwaves directed in the direction 36 may be approximately 6.5 times greater than the soundwaves 46 directed in a direction 44 that generally opposes the direction 36.

The preceding description is merely illustrative in nature and is in no way intended to limit the disclosure, its application, or uses. As used herein, the phrase at least one of A, B, and C should be construed to mean a logical (A or B or C), using a non-exclusive logical "or." It should be understood that the various steps within a method may be executed in different order without altering the principles of the present disclosure. Disclosure of ranges includes disclosure of all ranges and subdivided ranges within the entire range.

The headings (such as "Background" and "Summary") and sub-headings used herein are intended only for general organization of topics within the present disclosure and are not intended to limit the disclosure of the technology or any aspect thereof. The recitation of multiple embodiments having stated features is not intended to exclude other embodiments having additional features, or other embodiments incorporating different combinations of the stated features.

As used herein, the terms "comprise" and "include" and their variants are intended to be non-limiting, such that recitation of items in succession or a list is not to the exclusion of other like items that may also be useful in the devices and methods of this technology. Similarly, the terms "can" and "may" and their variants are intended to be non-limiting, such that recitation that an embodiment can or may comprise certain elements or features does not exclude other embodiments of the present technology that do not contain those elements or features.

The broad teachings of the present disclosure can be implemented in a variety of forms. Therefore, while this disclosure includes particular examples, the true scope of the disclosure should not be so limited since other modifications will become apparent to the skilled practitioner upon a study of the specification and the following claims. Reference herein to one aspect or various aspects means that a particular feature, structure, or characteristic described in connection with an embodiment or particular system is included in at least one embodiment or aspect. The appearances of the phrase "in one aspect" (or variations thereof) are not necessarily referring to the same aspect or embodiment. It should also be understood that the various method steps discussed herein do not have to be carried out in the same order as depicted, and not each method step is required in each aspect or embodiment.

The foregoing description of the embodiments has been provided for purposes of illustration and description. It is not intended to be exhaustive or to limit the disclosure. Individual elements or features of a particular embodiment are generally not limited to that particular embodiment but, where applicable, are interchangeable and can be used in a selected embodiment, even if not specifically shown or described. The same may also be varied in many ways. Such variations should not be regarded as a departure from the disclosure, and all such modifications are intended to be included within the scope of the disclosure.

What is claimed is:

1. An acoustic structure for beaming at least a portion of soundwaves from a first direction toward a second direction, the acoustic structure comprising:

a plurality of phononic crystals;

wherein the plurality of phononic crystals have an outer border, an internal cavity and a channel extending between the outer border and the internal cavity, the channel defining an opening within the outer border;

wherein the phononic crystals are disposed such that the opening faces the second direction; and wherein soundwaves from the first direction are beamed to the second direction by the plurality of phononic crystals.

2. The acoustic structure of claim 1, wherein the second direction is approximately 90 degrees with respect to the first direction.

3. The acoustic structure of claim 1, wherein the plurality of phononic crystals are cylindrical phononic crystals.

4. The acoustic structure of claim 3, wherein the internal cavity of the plurality of phononic crystals extends along a length of the cylindrical phononic crystals.

5. The acoustic structure of claim 3, wherein the opening of the plurality of phononic crystals extends along a length of the cylindrical phononic crystals.

6. The acoustic structure of claim 1, wherein the plurality of phononic crystals are prism phononic crystals.

7. The acoustic structure of claim 6, wherein the internal cavity of the plurality of phononic crystals extends along a length of the prism phononic crystals.

8. The acoustic structure of claim 6, wherein the opening of the plurality of phononic crystals extends along a length of the prism phononic crystals.

9. The acoustic structure of claim 1, wherein a width of the channel is less than a width of the internal cavity.

10. The acoustic structure of claim 1, wherein a width of the channel is substantially equal to a width of the internal cavity.

11. The acoustic structure of claim 1, wherein the plurality of phononic crystals have a resonant frequency, wherein soundwaves beamed from the first direction to the second direction have a frequency higher than the resonant frequency of the plurality of phononic crystals.

12. The acoustic structure of claim 11, wherein the plurality of phononic crystals are separated from each other by a distance substantially equal to the speed of sound divided by a working frequency of the acoustic structure, wherein the working frequency is substantially similar to the frequency of the soundwaves beamed from the first direction to the second direction.

13. The acoustic structure of claim 1, wherein the plurality of phononic crystals form a lattice.

14. The acoustic structure of claim 13, wherein the plurality of phononic crystals are separated from each other by a distance substantially equal to the speed of sound divided by a working frequency of the acoustic structure.

15. The acoustic structure of claim 14, wherein the lattice of the plurality of phononic crystals are one of: a triangular lattice, a hexagonal lattice, and a square lattice.

16. The acoustic structure of claim 14, wherein frequencies of the soundwaves directed by the plurality of phononic crystals are higher than resonant frequencies of the plurality of phononic crystals.

17. The acoustic structure of claim 16, wherein the lattice forms a rectangular shape having a long side and a short side.

18. The acoustic structure of claim 17, wherein the long side faces the first direction and the short side faces the second direction.

19. The acoustic structure of claim 1, wherein the plurality of phononic crystals have substantially similar resonant frequencies.

20. The acoustic structure of claim 1, wherein the plurality of phononic crystals are periodic dielectric structures.

* * * * *